United States Patent [19]

Dillon

[11] 3,953,268

[45] Apr. 27, 1976

[54] METHOD OF INSTALLING TILE AND TILE TRIM ON A CABINET SURFACE

[76] Inventor: Elmer D. Dillon, 8775 Troy St., Spring Valley, Calif. 92077

[22] Filed: Jan. 2, 1974

[21] Appl. No.: 429,761

[52] U.S. Cl. ..... 156/71; 428/77; 428/81; 428/192; 52/255; 52/287; 52/371; 52/610

[51] Int. Cl.[2] ..... B32B 1/04; B32B 3/02; E04F 13/00; E04C 2/08

[58] Field of Search ..... 161/39, 44; 52/614, 52/392, 287, 255, 388, 288, 169, 610, 179, 52/389, 371; 428/77, 81, 192; 156/71

[56] References Cited

UNITED STATES PATENTS

| | | | |
|---|---|---|---|
| 2,750,312 | 6/1956 | Bloom, Jr. et al. | 161/44 |
| 2,904,856 | 9/1959 | Robinson | 52/255 |
| 2,969,616 | 1/1961 | Gustafson | 52/255 |
| 2,991,516 | 7/1961 | Boettcher | 52/287 |
| 3,109,207 | 11/1963 | Cooper | 52/255 |
| 3,307,313 | 3/1967 | Tatum | 52/255 X |
| 3,309,832 | 3/1967 | Filsinger | 52/287 X |
| 3,430,402 | 3/1969 | Gaiser | 52/287 |

*Primary Examiner*—Philip Dier

[57] ABSTRACT

An adjustable tile trim which can be constructed of tile itself, wood, plastic, or any suitable material, which has two inner surfaces substantially at right angles to each other, one of which abuts the front face of a cabinet, and the other surface fits over the terminating front edge of the tile, both surfaces being cemented. If the tile terminating edge is receded from the edge of a counter, a filler such as mortar is placed between the terminating tile edge and the face of the cabinet for structural strength and other purposes. Hence, the necessity of trimming the tile to the trim has been obviated in that the trim can accommodate any range of termination setback from the face of the counter and the trim is adjustable in a vertical plane to accommodate any thickness of tile.

1 Claim, 3 Drawing Figures

METHOD OF INSTALLING TILE AND TILE TRIM ON A CABINET SURFACE

PRIOR ART

The following U.S. Pat. Nos. were turned up in a patentability search of the instant invention: 1,750,256, Bonfield, 2,115,130 Thurn, 2,186,684 Ritter, 2,785,937 Murray, 1,833,672 De Vol, 2,705,820 Torrence, 2,991,516 Boettcher.

BRIEF DESCRIPTION OF THE INVENTION

The present invention relates to an adjustable tile trim and, more particularly, to an adjustable tile trim for accommodating varying terminating positions of tile and tile thickness.

According to the invention, an adjustable tile trim is provided which has inside surfaces substantially 90° to each other. In a typical installation where a horizontal counter covered with tile is to be trimmed on the front corner thereof, the tile is first laid on the counter of a kitchen cabinet and a filler such as mortar is filled in the space between the terminating front edge of the tile and the front surface of the counter. The back edge of the tile is installed flush with the termination of the counter or the wall. Cement is then placed on the inside surfaces of the tile trim and the tile trim placed against the front vertical surface of the cabinet and over the filler, if necessary, and terminating row of tile. It is contemplated that the trim will be wood or wood-colored to match the face of the cabinet which obviates the frustrating attempt to match the color of the tile itself. With this method of construction, the necessity of trimming the tile to the dimension of the counter has been eliminated which, of course, is a tremendous labor saving expedient, and it is not necessary to match the thickness of the tile since the trim fits over the terminating edge of the tile.

An object of the present invention is the provision of an improved tile cabinet trim.

Another object of the invention is the provision of an improved method of installing cabinet tile and trim.

A further object of the invention is the provision of an improved tile cabinet and trim which economized on labor and material.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein:

FIG. 1 is a perspective view of a typical prior art installation of a tile counter and trim; and FIGS. 2 and 3 are perspective views of the preferred embodiment of the present invention with different tile terminations considerations.

DETAILED DESCRIPTION OF THE DRAWING

Figure 1:
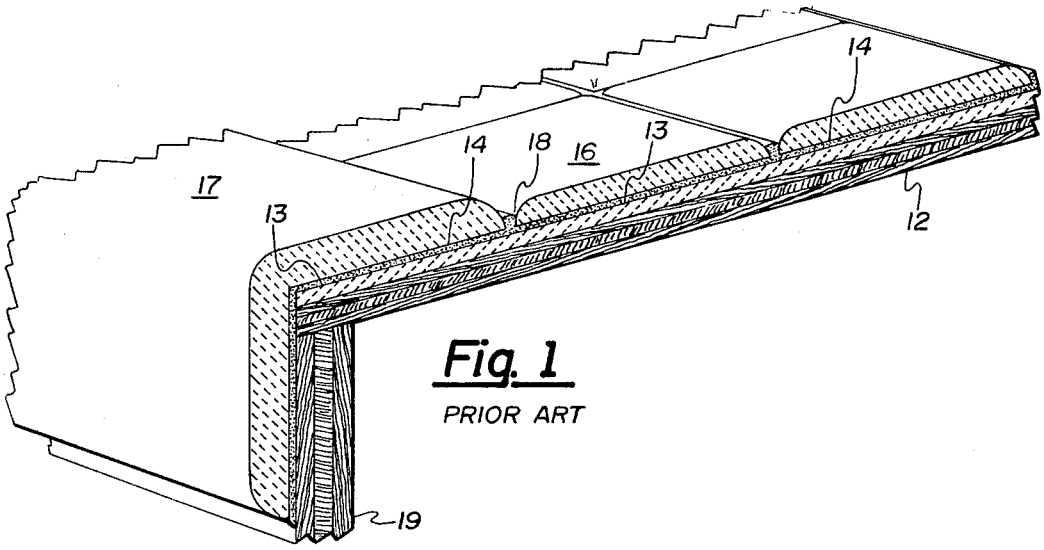
Fig. 1 PRIOR ART

Referring to FIG. 1, a tile counter and trim is shown generally in which a wood deck 12 from the top surface of a counter or cabinet is covered with a mortar 13. A layer of adhesive mortar 14 is disposed between mortar 13 and tile strip 16. A corner trim piece 17 is shown abutting the terminating edge 18 of tile strip 16 and is carried by adhesive mortar 14. Corner trim piece 17 abuts the front edge 19 of the cabinet.

Figure 2:
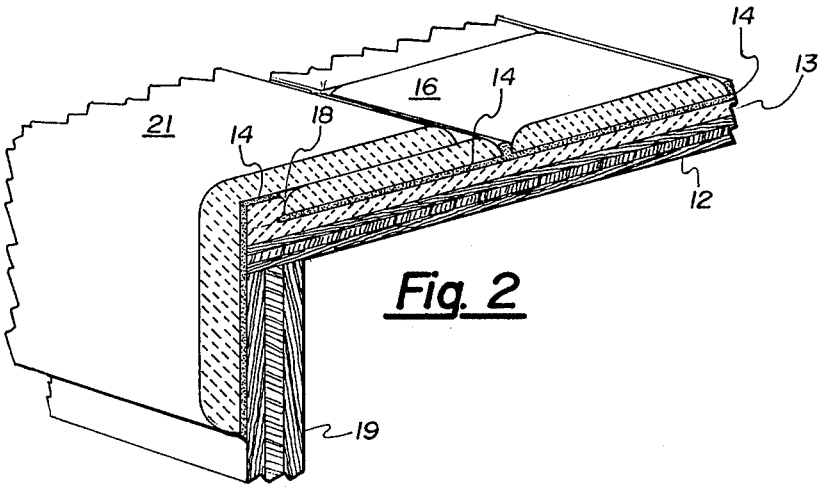
Figure 3:
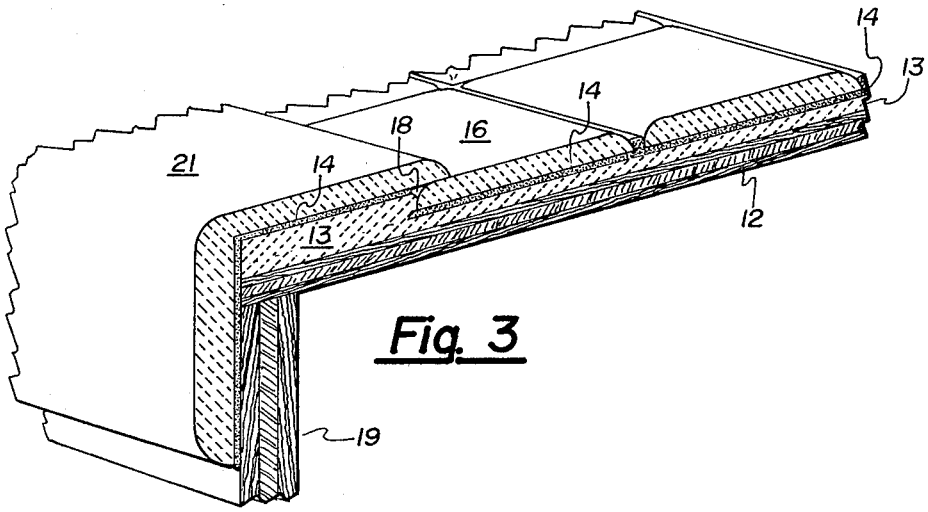

Referring to FIGS. 2 and 3, 3 ply wood deck 12 carried a layer of mortar filler 13. A layer of adhesive mortar 14 is disposed between mortar filler 13 and tile strip 16. Corner trim piece 21 is dimensioned for extending between a 3 ply wood front face 19 of the cabinet and overlapping front edge 18 of tile strip 16. Mortar filler 13 is disposed between the front edge 18 of tile strip 16 and beneath corner trim piece 21.

Referring back to FIG. 1, it can be seen that because of the dimensioning of corner trim piece 17 and method of installation, it is necessary for tile strip 16 to abut corner strip 17 at its terminating edge 18. This, of course, necessitates the trimming of the other edge (not shown) of tile strip 16 to coincide with the termination of the top surface of the cabinet, which is most cases is a wall surface. This installation procedure is of course expensive, requiring extremely skilled personnel, resulting in a costly and time-consuming installation.

Referring to FIGS. 2 and 3, it can be seen that depending upon the length of the tile squares and the length of the cabinet, the terminating front edge of the tile strips can vary in from fro the front face 19 of the cabinet. This is, of course, due to the placement of the tile strips on the cabinet without trimming, i.e., the other edge abuts the terminating wall or edge of the cabinet and is brought forward to terminate where it may, depending again on the relative dimensions of the tile strip and the cabinet. The method of the present invention contemplates the top depth of the corner trim piece to be greater than a single tile length in the tile strip. The corner trim 21 is placed over the tile strip with suitable filler in the space between the edge of the tile strip and the inside of the corner piece. This results in a corner trim piece which accommodates variable relative lengths of the tile strip and the cabinet and is automatically adjustable to accomodate the thickness of the tile and variances in layers of wood, mortar and adhesive mortar by merely moving the corner piece in a vertical plane. In this installation, as shown in FIG. 3 the tile strip 16 is first placed on the adhesive mortar 14 and the space between the edge 18 of the tile strip and the front face 19 of the cabinet is filled with a filler such as mortar. At this time, the trim piece 21 is cemented to the exposed surfaces, resulting in an expeditious, economical and decorious installation.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. The method of installing tile and tile trim on a cabinet surface comprising the steps of:

applying a filler coating on a cabinet surface;

applying an adhesive coating on said filler coating;

applying tile strips untrimmed as to length to the adhesive coating;

adding filler in any space between the terminating edge of the tile strips and a corner of the cabinet; and cementing a strip of corner trim to the front corner of said cabinet, said corner trim having first and second inside surfaces angled for cooperation with and overlapping the corner of said cabinet, with one of said first and second surfaces being cemented to the top surface of the tile the strip adjacent to said corner strip, and overlapping the end of said tile strip.

* * * * *